US010443191B2

(12) United States Patent
Hong et al.

(10) Patent No.: US 10,443,191 B2
(45) Date of Patent: Oct. 15, 2019

(54) ROPE FOR ELEVATOR AND MANUFACTURING METHOD THEREFOR

(71) Applicant: Kiswire Ltd., Busan (KR)

(72) Inventors: Sung Hee Hong, Busan (KR); Yeon Hwan Bae, Gyeongsangbuk-do (KR)

(73) Assignee: Kiswire Ltd., Busan (KR)

( * ) Notice: Subject to any disclaimer, the term of this patent is extended or adjusted under 35 U.S.C. 154(b) by 490 days.

(21) Appl. No.: 15/318,565

(22) PCT Filed: Jun. 18, 2015

(86) PCT No.: PCT/KR2015/006212
§ 371 (c)(1),
(2) Date: Dec. 13, 2016

(87) PCT Pub. No.: WO2015/194893
PCT Pub. Date: Dec. 23, 2015

(65) Prior Publication Data

US 2017/0129742 A1 May 11, 2017

(30) Foreign Application Priority Data

Jun. 19, 2014 (KR) ..... 10-2014-0075058

(51) Int. Cl.
*D07B 1/06* (2006.01)
*B66B 7/06* (2006.01)
*D07B 5/00* (2006.01)

(52) U.S. Cl.
CPC ..... *D07B 1/0673* (2013.01); *B66B 7/06* (2013.01); *B66B 7/062* (2013.01); *D07B 1/06* (2013.01);
(Continued)

(58) Field of Classification Search
CPC ..... D07B 1/06; D07B 1/0673; D07B 1/068; D07B 1/0686; D07B 1/0693
(Continued)

(56) References Cited

U.S. PATENT DOCUMENTS 1,373,632 A * 4/1921 Phelps ..... D07B 1/068 57/213
2,604,509 A * 7/1952 Blanchard ..... H01B 7/046 138/130
(Continued)

FOREIGN PATENT DOCUMENTS

CN 201656879 U 12/2010
CN 103526618 A 1/2014
(Continued)

OTHER PUBLICATIONS

Machine Translation of CN 201686879, obtained Jun. 20, 2019.*
(Continued)

*Primary Examiner* — Shaun R Hurley
(74) *Attorney, Agent, or Firm* — McCarter & English, LLP

(57) ABSTRACT

The present invention relates to a rope for an elevator. The rope for the elevator comprises: a center strand formed by twisting a plurality of wires; inner layer strands formed by twisting the plurality of wires and arranged along the outer periphery of the center strand; and outer layer strands formed by twisting the plurality of wires and arranged along the outer periphery of the inner layer strands, wherein ten of each of the inner layer strands and the outer layer strands are prepared, the diameter of the center strand, the diameter of the inner layer strand and the diameter of the outer layer strand are respectively 0.33-0.35 times, 0.13-0.15 times and
(Continued)

0.22-0.24 times as large as the diameter of a first imaginary circle circumscribed around the outer layer strands, and a fill factor is 64-67%.

4 Claims, 2 Drawing Sheets

(52) U.S. Cl.
CPC ..... *D07B 1/0686* (2013.01); *D07B 5/005* (2013.01); *D07B 2201/102* (2013.01); *D07B 2201/1016* (2013.01); *D07B 2201/1036* (2013.01); *D07B 2201/1076* (2013.01); *D07B 2201/202* (2013.01); *D07B 2201/2006* (2013.01); *D07B 2201/2025* (2013.01); *D07B 2201/2037* (2013.01); *D07B 2201/2051* (2013.01); *D07B 2201/2061* (2013.01); *D07B 2501/2007* (2013.01)

(58) Field of Classification Search
USPC ..... 57/212, 213, 214, 218
See application file for complete search history.

(56) References Cited

U.S. PATENT DOCUMENTS

| | | | | | |
|---|---|---|---|---|---|
| 3,413,799 | A * | 12/1968 | Lejeune | B60C 15/04 | 152/556 |
| 3,977,174 | A * | 8/1976 | Boileau | B60C 9/0028 | 57/212 |
| 4,365,467 | A * | 12/1982 | Pellow | D07B 1/0673 | 57/212 |
| 2002/0174645 | A1* | 11/2002 | Nguyen | B60C 9/0007 | 57/213 |

FOREIGN PATENT DOCUMENTS

| | | | |
|---|---|---|---|
| DE | 1 817 678 | A1 | 7/1969 |
| EP | 0 199 461 | A2 | 10/1986 |
| EP | 0 675 223 | A1 | 10/1995 |
| JP | 2849620 | B2 | 1/1999 |
| KR | 10-0623815 | B1 | 9/2006 |
| WO | WO 01/49926 | A1 | 7/2001 |
| WO | WO 2004/065276 | A1 | 8/2004 |

OTHER PUBLICATIONS

International Search Report (ISR) and Written Opinion issued by Korean Patent Office, acting as the International Searching Authority, for International Application PCT/KR2015/006212 dated Sep. 23, 2015 in Korean with English translation of ISR.

Molkow, Dr.-Ing. Michael et al.: "Educational Focus: Elevator Suspension Systems, Wire Rope for Elevator Suspension", *Elevator World*, May 2003, pp. 100, 103-104, 106, 108, 110, 112-114 and 116-117 (total 11).

Extended European Search Report prepared by the European Patent Office for coresponding European application 15808960.7 dated Feb. 9, 2018.

* cited by examiner

ROPE FOR ELEVATOR AND MANUFACTURING METHOD THEREFOR

CROSS-REFERENCE TO RELATED APPLICATIONS

This application is the National Stage entry under 35 U.S.C. § 371 of International Application Number PCT/KR2015/006212 filed on Jun. 18, 2015, published on Dec. 23, 2015 under publication number WO 2015/194893 A1, which claims the benefit of priority under 35 U.S.C. § 119 of Korean patent application number 10-2014-0075058 filed Jun. 19, 2014.

TECHNICAL FIELD

The present invention relates to a rope for an elevator and a manufacturing method therefor, and more particularly, to a rope for an elevator and a manufacturing method therefor, whereby the structure may be stabilized due to an increased number of strands and a high fill factor, excellent roundness and dimensional stability may be obtained, and riding comfort may be improved by minimizing vibration in times of driving the elevator.

BACKGROUND ART

In general, a conventional elevator rope for mid-rise/high-rise buildings is composed of eight outer layer strands and a center (independent wire rope core (IWRC) or fiber). Usually, products to which fiber has been applied are used for main traction, and products to which IWRC has been applied are used in governors.

However, as a high safety factor is needed for use in super high-rise buildings, higher breaking load is required, compared to the conventional elevator rope having a fiber center. Although the strength of wires may be improved in order to obtain high breaking load, due to characteristics of elevator ropes, main traction ropes cause friction with traction sheaves, and thus, there is a limit to increasing the strength of wires used to form elevator ropes. That is, the higher the strength of wires, the shorter the life of sheaves (normally, the hardness of wires contacting sheaves is less than that of the sheaves, and the wires maintain Vickers hardness at about 450±30), and accordingly, the IWRC is used instead of the fiber center.

As described above, although elevator ropes for super high-rise buildings, to which the IWRC has been applied, are used, eight outer layer strands are still used currently as in conventional elevator ropes for mid-rise/high-rise buildings. For safe running in times of high-speed running of elevators in super high-rise buildings, elevator ropes are required to be more structurally stabilized.

DETAILED DESCRIPTION OF THE INVENTION

Technical Problem

As the number of super high-rise buildings has increased recently, demand for elevator ropes for use in super high-rise buildings has increased, and these elevator ropes have been required to have a high safety factor, a high elastic coefficient and a low elongation rate because of long-distance running, compared to conventional elevator ropes for mid-rise/high-rise buildings. Further, minimization of vibration has been required in order to maintain riding comfort in times of running and getting on/off when elevators run a long distance at a high speed.

The present invention has been created to satisfy such demands and particularly provides an elevator rope and a manufacturing method therefor, whereby the structure may be stabilized due to an increased number of strands and a high fill factor, excellent roundness and dimensional stability may be obtained, and riding comfort may be improved by minimizing vibration in times of driving an elevator.

Technical Solution

According to an aspect of the present invention, a rope for an elevator includes: a center strand formed by twisting a plurality of wires; inner layer strands formed by twisting the plurality of wires and arranged along the outer periphery of the center strand; and outer layer strands formed by twisting the plurality of wires and arranged along the outer periphery of the inner layer strands, wherein ten of each of the inner layer strands and the outer layer strands are prepared, a diameter of the center strand, a diameter of the inner layer strands and a diameter of the outer layer strands are respectively 0.33-0.35 times, 0.13-0.15 times and 0.22-0.24 times as large as a diameter of a first imaginary circle circumscribed around the outer layer strands, and a fill factor is 64-67%.

Also, when a gap formed by spacing apart the inner layer strands that are adjacent to each other is defined as a gap (NG) between the inner layer strands, and a diameter of a second imaginary circle circumscribed around the inner layer strands is defined as an inner layer rope diameter (NR), the relationship of $0.3\% \leq (NG/NR) \times 100 \leq 0.6\%$ may be established, and when a gap formed by spacing apart the outer layer strands that are adjacent to each other is defined as a gap (OG) between the outer layer strands, and the diameter of the first imaginary circle circumscribed around the outer layer strands is defined as an outer layer rope diameter (OR), the relationship of $0.5\% \leq (OG/OR) \times 100 \leq 1.0\%$ may be established.

Also, a pitch of the center strand may be 6-8 times as large as the diameter of the center strand, a pitch of the inner layer strands may be 8-10 times as large as the diameter of the inner layer strands, and a pitch of the outer layer strands may be 6.5-8.5 times as large as the diameter of the outer layer strands.

According to another aspect of the present invention, a method of manufacturing a rope for an elevator includes: a strand setting operation in which a center strand formed by twisting a plurality of wires is disposed, ten inner layer strands each formed by twisting the plurality of wires are arranged along the outer periphery of the center strand, and ten outer layer strands each formed by twisting the plurality of wires are arranged along the outer periphery of the inner layer strands; and a single dosing operation in which the center strand, the inner layer strands and the outer layer strands are twisted simultaneously so that a fill factor ranges between 64-67%, wherein a diameter of the center strand, a diameter of the inner layer strands and a diameter of the outer layer strands are respectively 0.33-0.35 times, 0.13-0.15 times and 0.22-0.24 times as large as a diameter of a first imaginary circle circumscribed around the outer layer strands.

In this respect, in the single closing operation, when a gap formed by spacing apart the inner layer strands that are adjacent to each other is defined as a gap (NG) between the inner layer strands, and a diameter of a second imaginary circle circumscribed around the inner layer strands is defined as an inner layer rope diameter (NR), the relationship of 0.3%≤(NG/NR)×100 0.6% may be established, and when a gap formed by spacing apart the outer layer strands that are adjacent to each other is defined as a gap (OG) between the outer layer strands, and the diameter of the first imaginary circle circumscribed around the outer layer strands is defined as an outer layer rope diameter (OR), the relationship of 0.5%≤(OG/OR)×100≤1.0% may be established.

In this respect, a pitch of the center strand may be 6-8 times as large as the diameter of the center strand, a pitch of the inner layer strands may be 8-10 times as large as the diameter of the inner layer strands, and a pitch of the outer layer strands may be 6.5-8.5 times as large as the diameter of the outer layer strands.

Advantageous Effects of the Invention

In a rope for an elevator and a manufacturing method therefor according to the present invention, the structure may be stabilized due to an increased number of strands and a high fill factor, excellent roundness and dimensional stability may be obtained, and riding comfort may be improved by minimizing vibration in times of driving the elevator.

MODE OF THE INVENTION

The present invention relates to an elevator rope for use in a super high-rise building and a manufacturing method therefor.

Hereinafter, exemplary embodiments according to the present invention will be described in detail with reference to the accompanying FIGS. 1 and 2.

Figure 1:
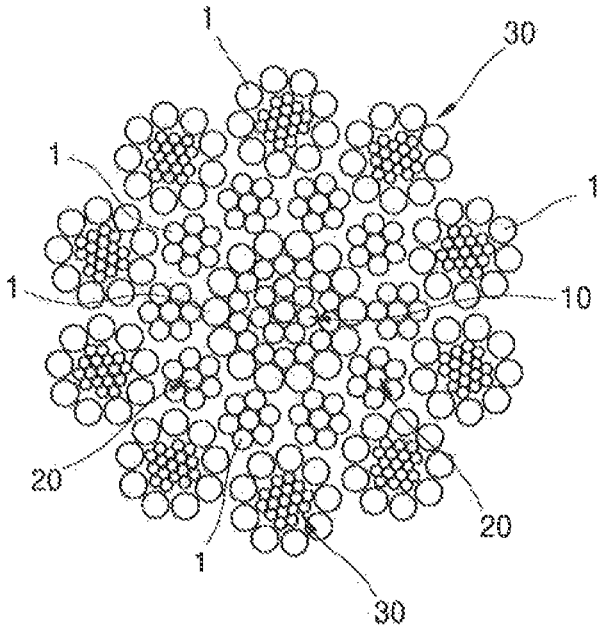
FIG. 1 is a cross-sectional view of a rope for an elevator, according to an embodiment of the present invention.

As shown in FIG. 1, a rope for an elevator according to an aspect of the present invention includes a center strand 10, an inner layer strand 20, and an outer layer strand 30.

The center strand 10 is disposed in the center of the rope for an elevator and is formed by twisting a plurality of wires 1. The plurality of wires 1 are made of steel.

The inner layer strand 20 is disposed along the outer periphery of the center strand 10, and according to the present embodiment, ten inner layer strands 20 are prepared. Each of the inner layer strands 20 is formed by twisting the plurality of wires 1.

The outer layer strand 30 is disposed along the outer periphery of the inner layer strand 20, and according to the present embodiment, ten outer layer strands 30 are prepared as in the case of the inner layer strand 20. Each of the outer layer strands 30 is also formed by twisting the plurality of wires 1.

A diameter of the center strand 10, a diameter of the inner layer strand 20 and a diameter of the outer layer strand 30 are respectively 0.33-0.35 times, 0.13-0.15 times and 0.22-0.24 times as lame as a diameter of a first imaginary circle 40 circumscribed around the outer layer strands 30, and a fill factor is 64-67%.

By preparing ten inner layer strands 20 and ten outer layer strands 30, a contact surface area with a sheave may be increased compared to a conventional rope, and thus, surface pressure may be dispersed. Accordingly, the rope may maintain its roundness well, and the dimensional stability of the rope may also be maintained well.

Also, as shown in FIG. 1, a diameter of each strand is formed to be small in this stated order: the diameter of the center strand 10, the diameter of the outer layer strand 30 and the diameter of the inner layer strand 20, and is set to fall within the above-described range with respect to the diameter of the first circle 40 so that the fill factor may be maintained, as described above, as high as 64-67%, and at the same time, a rope diameter may be within a permissible tolerance range (EN12385-5) of the rope diameter. That is, the permissible tolerance range of the rope diameter is given as +2% from a rope nominal diameter, and in the rope for an elevator according to the present invention, the diameter of each strand is set to be in the above-described range, thereby satisfying the permissible tolerance range. When the diameter of each strand is out of the above-described range with respect to the diameter of the first circle 40, the fill factor is less than 64% or exceeds 67%, and the rope diameter is out of the permissible tolerance range of the rope diameter.

Further, in the rope for an elevator according to the present embodiment, the center strand 10, the inner layer strand 20 and the outer layer strand 30 are manufactured by a single closing process, and thus, the fill factor is maintained as high as in the above-described range. The single closing process will be described in detail when describing later a method of manufacturing a rope for an elevator, according to the present invention.

According to an embodiment of the present invention, spacing of the inner layer strands 20 and spacing of the outer layer strands 30 are set as below.

Figure 2:
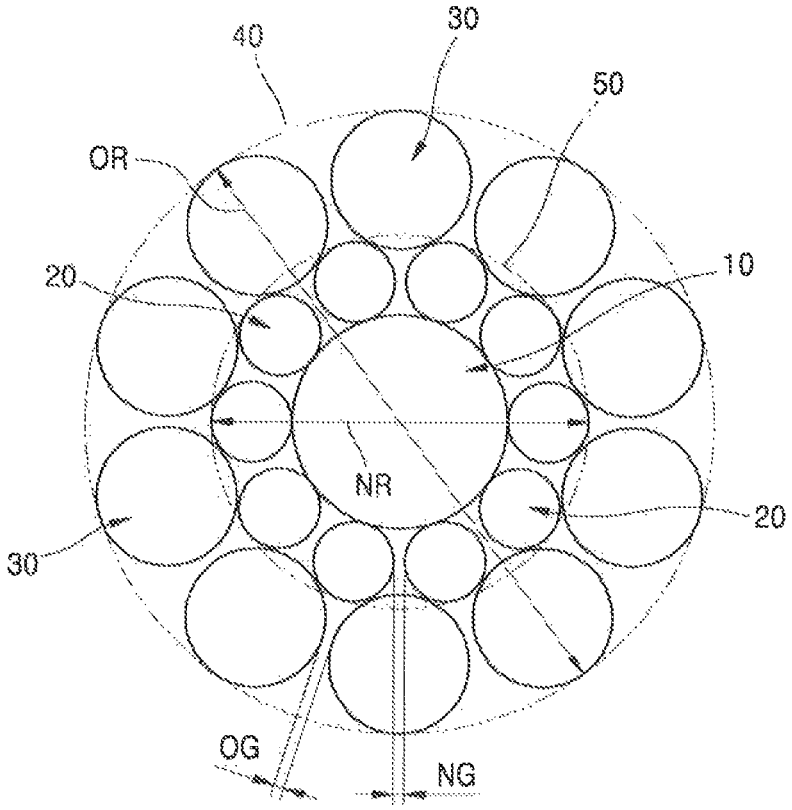
FIG. 2 is a drawing schematically illustrating FIG. 1 in terms of strands.

As shown in FIG. 2, when a gap formed by spacing apart adjacent inner layer strands 20 is defined as a gap NG between the inner layer strands 20, and a diameter of a second imaginary circle 50 circumscribed around the inner layer strands 20 is defined as an inner layer rope diameter NR, the relationship of 0.3%≤(NG/NR)×100≤0.6% is established. In this respect, (NG/NR)×100 is defined as spacing of the inner layer strands 20.

In addition, when a gap formed by spacing apart adjacent outer layer strands 30 is defined as a gap OG between the outer layer strands 30, and the diameter of the first imaginary circle 40 circumscribed around the outer layer strands 30 is defined as an outer layer rope diameter OR, the relationship of 0.5%≤(OG/OR)×100≤1.0% is established. In this respect, (OG/OR)×100 is defined as spacing of the outer layer strands 30.

Spacing is an essential element of elevator ropes and has a lot to do with a structural elongation rate and fatigue life. When spacing is large, the structural elongation rate increases, and dimensional stability deteriorates. On the other hand, when spacing is too small, the structural elongation rate decreases, whereas interlocking pressure between strands increases, thereby degrading flexibility and decreasing fatigue life.

According to the embodiment of the present invention, as described above, spacing of the inner layer strands 20 is set to range between 0.3% and 0.6%, and spacing of the outer layer strands 30 is set to range between 0.5% and 1.0%. Thus, no interlocking pressure may occur while the rope is used, and structural instability due to excessive spacing may be solved.

Accordingly, since spacing of the inner layer strands 20 and the outer layer strands 30 is set to be in the above-described range, the rope may have a high fill factor, thereby increasing breaking load and improving a safety factor of the rope. Furthermore, the rope may have a high elastic coefficient and a low elongation rate. Due to the high elastic coefficient and the low elongation rate, vibration during driving of an elevator is minimized, and thus, riding comfort increases.

Also, according to the embodiment of the present invention, a pitch of the center strand 10 is formed to be 6-8 times as large as the diameter of the center strand 10, a pitch of the inner layer strand 20 is formed to be 8-10 times as large as the diameter of the inner layer strand 20, and a pitch of the outer layer strand 30 is formed to be 6.5-8.5 times as large as the diameter of the outer layer strand 30.

As the pitches are set to be in the above-described ranges, all the strands constituting the rope are subjected to loading when the rope is subjected to loading, and accordingly, a structural elongation rate of the rope decreases, and load distribution additionally becomes uniform. When the pitches are out of the above-described ranges, load is relatively concentrated on one or two of the center strand 10, the inner layer strand 20, and the outer layer strand 30, and the rest of them is less subjected to loading, causing lack of uniformity in load distribution. For example, load may be concentrated on the center strand 10, and the inner layer strand 20 or the outer layer strand 30 may be relatively less subjected to loading.

According to another aspect of the present invention, there is provided a method of manufacturing the above-described rope for an elevator.

The method of manufacturing a rope for an elevator, according to the present embodiment, includes a strand setting operation and a single closing operation.

The strand setting operation is an operation of disposing the center strand 10 formed by twisting the plurality of wires 1, arranging, along the outer periphery of the center strand 10, ten inner layer strands 20 formed by twisting the plurality of wires 1, and arranging, along the outer periphery of the inner layer strands 20, ten outer layer strands 30 formed by twisting the plurality of wires 1. The plurality of wires 1 used to form each strand are made of steel.

In this respect, a pitch of the center strand 10 is set to be 6-8 times as large as a diameter of the center strand 10, a pitch of the inner layer strand 20 is set to be 8-10 times as large as a diameter of the inner layer strand 20, and a pitch of the outer layer strand 30 is set to be 6.5-8.5 times as large as a diameter of the outer layer strand 30. After each strand having a pitch set as described above is previously manufactured, the strand setting operation is performed.

Also, the diameter of the center strand 10, the diameter of the inner layer strand 20 and the diameter of the outer layer strand 30 are respectively 0.33-0.35 times, 0.13-0.15 times and 0.22-0.24 times as large as a diameter of the first imaginary circle 40 circumscribed around the outer layer strands 30. Actions and effects caused by setting a range of a diameter of each strand as described above have already been described above, and thus, detailed descriptions thereof are omitted.

Next, the single closing operation is performed. A closing process refers to a process of twisting ropes, and in the present embodiment, the single closing operation refers to manufacturing, after disposing the center strand 10, the inner layer strand 20 and the outer layer strand 30 during the strand setting process, a rope by twisting an of them at a time.

As described above, while the diameter of each strand is set to be in the above-described range, the center strand 10, the inner layer strand 20 and the outer layer strand 30 are twisted simultaneously, and thus, a fill factor becomes 64-67%.

The single closing operation is performed such that spacing of the inner layer strands 20 and spacing of the outer layer strands 30 is maintained in the ranges as described below.

That is, the single closing operation is performed such that, when a gap formed by spacing apart adjacent inner layer strands 20 is defined as a gap NG between the inner layer strands 20, and a diameter of a second imaginary circle 50 circumscribed around the inner layer strands 20 is defined as an inner layer rope diameter NR, the relationship of $0.3\% \leq (NG/NR) \times 100 \leq 0.6\%$ is established, and when a gap formed by spacing apart adjacent outer layer strands 30 is defined as a gap OG between the outer layer strands 30, and the diameter of the first imaginary circle 40 circumscribed around the outer layer strands 30 is defined as an outer layer rope diameter OR, the relationship of $0.5\% \leq (OG/OR) \times 100 \leq 1.0\%$ is established. Actions and effects caused by setting spacing of the inner layer strands 20 and spacing of the outer layer strands 30 to be in the above-described ranges have already been described above, and thus, detailed descriptions thereof are omitted.

As described above, in a rope for an elevator and a manufacturing method therefor according to the present invention, ten of each of the inner layer strand 20 and the outer layer strand 30 disposed around the center strand 10 is prepared, and thus, surface pressure is dispersed during contact with a sheave, and structural stability is increased.

Also, diameters of the center strand 10, the inner layer strand 20, and the outer layer strand 30 are set to fall within predetermined ranges with respect to a diameter of the first circle 40, and spacing of the inner layer strands 20 and spacing of the outer layer strands 30 are set to be in predetermined ranges, thereby increasing a fill factor and thus improving breaking load and an elastic coefficient of the rope and decreasing an elongation rate of the rope.

While the present invention has been described in detail above with reference to exemplary embodiments, the present invention is not limited to the exemplary embodiments, and various changes in form and details may be made therein without departing from the spirit and scope of the present invention as defined by the following claims.

The invention claimed is:

1. A rope for an elevator, the rope comprising:

a center strand (10) formed by twisting a first plurality of wires;

inner layer strands (20) formed by twisting a second plurality of wires and arranged along an outer periphery of the center strand (10); and outer layer strands (30) formed by twisting a third plurality of wires and arranged along an outer periphery of the inner layer strands (20), wherein ten of each of the inner layer strands (20) and the outer layer strands (30) are prepared, a diameter of the center strand (10), a diameter of the inner layer strands (20) and a diameter of the outer layer strands (30) are respectively 0.33-0.35 times, 0.13-0.15 times and 0.22-0.24 times as large as a diameter of a first imaginary circle (40) circumscribed around the outer layer strands (30), and a fill factor is 64-67%, wherein, a gap formed by spacing apart the inner layer strands (20) that are adjacent to each other is defined as a gap (NG) between the inner layer strands (20), and a diameter of a second imaginary circle (50) circumscribed around the inner layer strands (20) is defined as an inner layer rope diameter (NR), that relationship of 0.3%≤(NG/NR)×100 ≤0.6% is established, and wherein a gap formed by spacing apart the outer layer strands (30) that are adjacent to each other is defined as a gap (OG) between the outer layer strands (30), and the diameter of the first imaginary circle (40) circumscribed around the outer layer strands (30) is defined as an outer layer rope diameter (OR), the relationship of 0.5%≤(OG/OR)×100 ≤1.0% is established.

2. The rope of claim 1, wherein a pitch of the center strand (10) is 6-8 times as large as the diameter of the center strand (10), a pitch of the inner layer strands (20) is 8-10 times as large as the diameter of the inner layer strands (20), and a pitch of the outer layer strands (30) is 6.5-8.5 times as large as the diameter of the outer layer strands (30).

3. A method of manufacturing a rope for an elevator, the method comprising:

a strand setting operation in which a center strand (10) formed by twisting a first plurality of wires is disposed, ten inner layer strands (20) each formed by twisting a second plurality of wires are arranged along an outer periphery of the center strand (10), and ten outer layer strands (30) each formed by twisting a third plurality of wires are arranged along an outer periphery of the inner layer strands (20); and a single closing operation in which the center strand (10), the inner layer strands (20) and the outer layer strands (30) are twisted simultaneously so that a fill factor ranges between 64-67%, wherein a diameter of the center strand (10), a diameter of the inner layer strands (20) and a diameter of the outer layer strands (30) are respectively 0.33-0.35 times, 0.13-0.15 times and 0.22-0.24 times as large as a diameter of a first imaginary circle (40) circumscribed around the outer layer strands (30), wherein, in the single closing operation, a gap formed by spacing apart the inner layer strands (20) that are adjacent to each other is defined as a cap (NG) between the inner layer strands (20), and a diameter of a second imaginary circle (50) circumscribed around the inner layer strands (20) is defined as an inner layer rope diameter (NR), the relationship of 0.3%≤(NG/NR)×100 ≤0.6% is established, and a gap formed by spacing apart the outer layer strands (30) that are adjacent to each other is defined as a gap (OG) between the outer layer strands (30), and the diameter of the first imaginary circle (40) circumscribed around the outer layer strands (30) is defined as an outer layer rope diameter (OR), the relationship of 0.5%≤(OG/OR)×100 ≤1.0% is established.

4. The method of claim 3, wherein a pitch of the center strand (10) is 6-8 times as large as the diameter of the center strand (10), a pitch of the inner layer strands (20) is 8-10 times as large as the diameter of the inner layer strands (20), and a pitch of the outer layer strands (30) is 6.5-8.5 times as large as the diameter of the outer layer strands (30).

* * * * *